US010317829B2

(12) United States Patent
Maeda

(10) Patent No.: US 10,317,829 B2
(45) Date of Patent: Jun. 11, 2019

(54) IMAGE-FORMING APPARATUS WITH FORCIBLE STOPPING OF ROTARY MEMBER

(71) Applicant: CANON KABUSHIKI KAISHA, Tokyo (JP)

(72) Inventor: Yoritsugu Maeda, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/749,510

(22) PCT Filed: Jul. 29, 2016

(86) PCT No.: PCT/JP2016/073020
§ 371 (c)(1),
(2) Date: Feb. 1, 2018

(87) PCT Pub. No.: WO2017/022841
PCT Pub. Date: Feb. 9, 2017

(65) Prior Publication Data

US 2018/0224778 A1 Aug. 9, 2018

(30) Foreign Application Priority Data

Aug. 4, 2015 (JP) ..... 2015-154290

(51) Int. Cl.
*G03G 15/20* (2006.01)
*G03G 15/00* (2006.01)
*G03G 15/04* (2006.01)

(52) U.S. Cl.
CPC ... *G03G 15/2064* (2013.01); *G03G 15/04036* (2013.01); *G03G 15/55* (2013.01);
(Continued)

(58) Field of Classification Search
USPC ..... 399/38, 67, 68, 107, 110, 122, 320, 328
See application file for complete search history.

(56) References Cited

U.S. PATENT DOCUMENTS 7,110,689 B2 9/2006 Takahashi
8,019,236 B2 * 9/2011 Abe ..... G03G 15/2028 399/122

(Continued)

FOREIGN PATENT DOCUMENTS

JP 2000-344395 A 12/2000
JP 2004-354983 A 12/2004

(Continued)

OTHER PUBLICATIONS

International Search Report and Written Opinion dated Oct. 25, 2016 in International Application No. PCT/JP2016/073020.

(Continued)

*Primary Examiner* — Hoan H Tran
(74) *Attorney, Agent, or Firm* — Venable LLP

(57) ABSTRACT

An image forming apparatus includes a rotary member which transports a recording material; a first detecting unit which is provided upstream of the rotary member in a transport direction of the recording material and detects the recording material; a second detecting unit which is provided downstream of the rotary member in the transport direction of the recording material and detects the recording material; a driving unit which drives the rotary member; a control unit which controls the driving unit to rotate and stop the rotary member; and stopping units which operate independently of the control unit and forcibly stop the driving unit based on detection results of the first detecting unit and the second detecting unit.

10 Claims, 9 Drawing Sheets

(52) U.S. Cl.
CPC ..... *G03G 15/602* (2013.01); *G03G 15/6573* (2013.01); *G03G 15/70* (2013.01); *G03G 2215/00548* (2013.01)

(56) References Cited

U.S. PATENT DOCUMENTS

| | | | |
|---|---|---|---|
| 2004/0247333 | A1 | 12/2004 | Takahashi |
| 2007/0237530 | A1 | 10/2007 | Sunada |

FOREIGN PATENT DOCUMENTS

| | | | |
|---|---|---|---|
| JP | 2008-225069 | A | 9/2008 |
| JP | 2008-276095 | A | 11/2008 |

OTHER PUBLICATIONS

International Preliminary Report on Patentability dated Feb. 15, 2018, in International Application No. PCT/JP2016/073020.

* cited by examiner

IMAGE-FORMING APPARATUS WITH FORCIBLE STOPPING OF ROTARY MEMBER

TECHNICAL FIELD

The present invention relates to an image forming apparatus, such as a copier or a printer using an electrophotographic process, which fixes a toner image formed on a recording material onto the recording material.

BACKGROUND ART

A conventional image forming apparatus, for example, a copier, a laser beam printer, or a facsimile machine, includes a fixing apparatus that fixes an unfixed toner image transferred onto the recording material. The recording material bearing the unfixed toner image is transported to a nip portion formed by a heating roller and a pressure roller of the fixing apparatus, and then the unfixed toner image is fixed onto the recording material. In this configuration, a toner image in a melted state comes into contact with a surface of a fixing roller during fixation, which may cause the recording material to wrap around the fixing roller. A conventionally proposed configuration for preventing wrapping of the recording material around the fixing roller includes a separating claw provided downstream of the nip portion of the fixing rollers in a transporting direction. If a leading end of the recording material is mostly wrapped around the fixing roller, the separating claw forcibly peels off the leading end of the recording material from the fixing roller. Another configuration is proposed with a cleaning member that removes toner deposited on the fixing roller.

In order to prevent wearing of the separating claw from reducing separation capability and prevent the applied amount of oil from decreasing in accordance with the high transport speed of the recording material, recently, the wrapping of the recording material around the fixing roller needs to be further prevented. Conventionally, two sensors for detecting the recording material are provided upstream and downstream of the fixing apparatus in the transport direction of the recording material so as to have a predetermined positional relationship therebetween, thereby detecting the wrapping of the recording material (For example, PTL 1 and PTL 2). If the leading end of a recording material P does not reach the outlet sensor within a predetermined time after passing through the inlet sensor, a control unit decides that the leading end of the recording material may have been wrapped around the fixing roller. Subsequently, the rotations of the fixing roller and the pressure roller are stopped to prevent the recording material from further entering the fixing apparatus.

CITATION LIST

Patent literature

PTL 1: Japanese Patent Application Laid-Open No. 2004-354983

PTL 2: Japanese Patent Application Laid-Open No. 2000-344395

SUMMARY OF INVENTION

Technical Problem

In the conventional configuration, a software processing time, from when a signal is input from the sensor until when a signal for stopping a fixing motor is output after the control unit detects a wrapping jam of the recording material, is not considered. For example, in the apparatus that includes a fixing roller with a high rotation speed and requires a long time for stopping the fixing roller, the fixing roller requires a long time to make a full stop. In this case, the fixing roller is rotated with the recording material wrapped around the fixing roller. Therefore, the recording material may enter into a position where the wrapped recording material is hard to remove.

The present invention has been devised under the present circumstances. An object of the present invention is to reduce a wrapping amount of the recording material around a rotary member when the recording material is wrapped around the rotary member.

Solution to Problem

In order to solve the problem, the present invention is configured as follows.

That is, an image forming apparatus includes: a rotary member that transports a recording material; a first detecting unit which is provided upstream of the rotary member in a transport direction of the recording material and detects the recording material; a second detecting unit which is provided downstream of the rotary member in the transport direction of the recording material and detects the recording material; a driving unit which drives the rotary member; a control unit which controls the driving unit to rotate and stop the rotary member; and a stopping unit which operates independently of the control unit and forcibly stops the driving unit based on detection results of the first detecting unit and the second detecting unit.

Advantageous Effects of Invention

The present invention can reduce the wrapping amount of the recording material around the rotary member when the recording material is wrapped around the rotary member.

Further features of the present invention will become apparent from the following description of exemplary embodiments with reference to the attached drawings.

DESCRIPTION OF EMBODIMENTS

Exemplary embodiments for implementing the present invention will be specifically described below with reference to the accompanying drawings.

First Embodiment

[Image Forming Apparatus]

Figure 1:
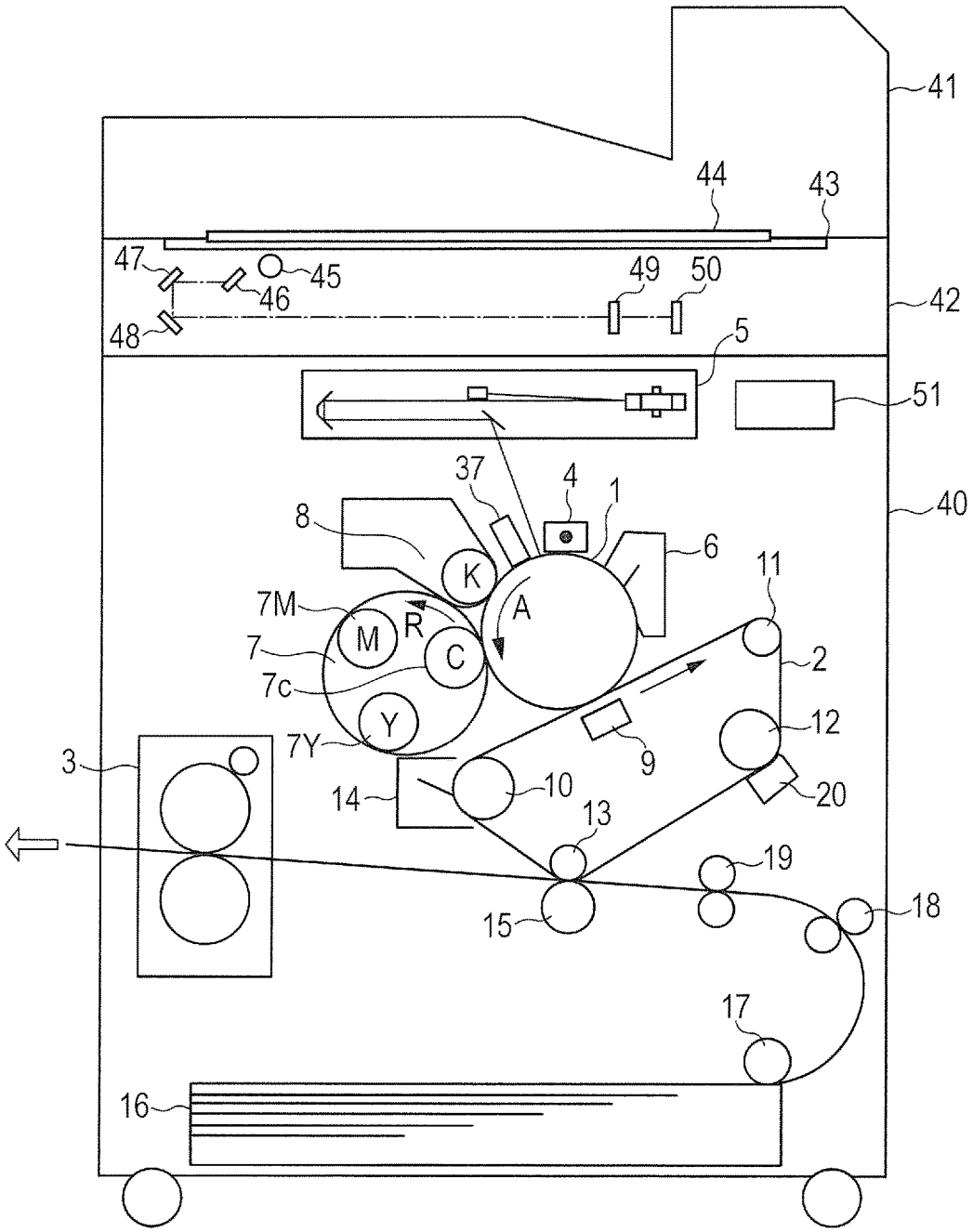
FIG. 1 is a vertical sectional view illustrating an image forming apparatus according to first and second embodiments.

FIG. 1 is a cross-sectional configuration diagram illustrating an image forming apparatus according to a first embodiment. The upper part of a color electrophotographic copier body (hereinafter, simply described as a body) 40 includes an automatic document transport apparatus 41 that automatically transports documents 44 one by one in a state separated from each other, and a document reading apparatus 42 that reads an image of each document 44 transported by the automatic document transport apparatus 41. The document reading apparatus 42 performs light exposure by illuminating the document 44 placed on a platen glass 43 with light from a light source 45 and scanning onto an image reading element 50 with light reflected from the document 44 through a reducing optical system. The reducing optical system includes optical mirrors 46, 47, and 48 and an imaging lens 49. The image reading element 50 is, for example, a CCD. The image reading element 50 reads a reflected light image from color materials forming the image on the document 44, with a predetermined dot density.

After being read by the document reading apparatus 42, the reflected light image of the document 44 is transmitted to an image processing apparatus 51 as three-color image data of R(red), G(green), and B(blue). The image processing apparatus 51 performs known image processing such as shading compensation, gamma correction, and color space processing on the image data of R, G, and B of the document 44. The image data having been subjected to predetermined image processing by the image processing apparatus 51 is transmitted to an exposing apparatus 5 as image data of Y(yellow), M(magenta), C(cyan), and K(black). The exposing apparatus 5 performs exposure with laser light according to the received image data. The exposing apparatus 5 exposes a photosensitive drum 1, which serves as an image bearing member, based on the image data. The photosensitive drum 1 can be rotated in the direction of arrow A (counterclockwise direction) in FIG. 1 by a motor (not shown). The photosensitive drum 1 is surrounded by a charger 4, a potential sensor 37, the exposing apparatus 5, a developing apparatus 7 (Y, M, C), a developing apparatus 8 (K), a transferring apparatus 9, and a cleaner apparatus 6.

The charger 4 uniformly charges the surface of the photosensitive drum 1 with a predetermined potential. The potential sensor 37 detects a potential on the surface of the photosensitive drum 1 charged by the charger 4, and performs feedback control on the intensity of charged voltage based on the detection result. The exposing apparatus 5 including a laser scanner exposes the photosensitive drum 1 such that an image part on which toner is deposited of the charged photosensitive drum 1 has a predetermined potential based on the image data. Thereby a latent image is formed on the photosensitive drum 1. The exposing apparatus 5 turns on or off the light source of the exposing apparatus 5 based on the image data, forming the latent image corresponding to the input image data.

The developing apparatus 7 includes developing apparatuses 7Y, 7M, and 7C for performing full-color development. The developing apparatuses 7Y, 7M, and 7C and the developing apparatus 8 develop a latent image formed on the photosensitive drum 1, with toners of Y, M, C, and K. When developing with the toner of each color, the developing apparatus 7 is rotated in the direction of arrow R (counterclockwise direction) by a driving source (not shown) and is positioned such that the developing apparatuses of the corresponding colors come into contact with the photosensitive drum 1. A toner image developed on the photosensitive drum 1 is transferred to a belt 2, which serves as an intermediate transfer member, by the transferring apparatus 9. These steps are sequentially performed for Y, M, C, and K to superimpose toner images of four colors on the belt 2, and a color toner image is formed. A belt cleaner 14 is disposed so as to face a roller 10 with the belt 2 interposed therebetween. After the toner image is transferred to a recording material, the belt cleaner 14 scrapes off toner remaining on the belt 2 with a blade.

The toner image transferred to the belt 2 is transferred to the recording material by the transferring apparatus 15. In the case of full-color printing, toner images of four colors are superimposed on the belt 2 and then are transferred to the recording material. The recording material is fed to a transport path from a cassette 16 by a pickup roller 17 and then is transported to a contact portion (hereinafter, described as a nip portion) between the transferring apparatus 15 and the belt 2 by transport roller pairs 18 and 19. Toner remaining on the photosensitive drum 1 is removed and collected by the cleaner apparatus 6. After that, the charge is eliminated from the photosensitive drum 1 to about 0 V by a charge eliminating apparatus (not shown), and then the photosensitive drum 1 is ready for a subsequent image forming cycle.

The recording material having the transferred toner image is transported to the fixing device 3 (fixing unit). After the unfixed toner image on the recording material is fixed by the fixing device 3, the recording material is discharged out of the apparatus (an arrow outline with a blank inside). The fixing device 3 includes a pair of rollers provided as a pair of rotary members. The two rollers containing halogen heaters 222 and 223 (FIG. 2) acting as heat generating units are rotatably disposed so as to be pressed to each other by a pressing mechanism (not shown).

Timing for image formation of the body 40 is controlled with respect to a predetermined position on the belt 2. The belt 2 is suspended around the roller 10 and rollers 11, 12, and 13. The roller 10 is driven by the driving source (not shown) and acts as a roller for driving the belt 2. The rollers 11 and 12 act as tension rollers that adjust the tension of the belt 2. The roller 13 acts as a backup roller of the transferring apparatus 15. A reflection sensor 20 for detecting a reference position is disposed near the roller 12 so as to face the roller 12 with the belt 2 interposed therebetween. The sensor 20 is disposed on one end of the belt 2 in a direction orthogonal to the moving direction (arrow direction in FIG. 1) of the belt 2. The sensor 20 detects a marking such as reflective tape provided on one end of the outer peripheral surface of the belt 2 and then outputs a reference signal (hereinafter, described as an I-top signal) for the timing of image formation process.

The circumference of the photosensitive drum 1 and the perimeter of the belt 2 have an integer ratio of 1 to n (integer). This setting allows the photosensitive drum 1 to rotate n (n is integer) times while the belt 2 rotates once, returning to substantially the same state as before the rotation of the belt 2. Thus, when toner images of four colors are superimposed on the belt 2, in other words, when the belt 2 rotates four times, a color shift caused by uneven rotations of the photosensitive drum 1 can be reduced.

In the image forming apparatus according to the intermediate transfer method, the exposing apparatus 5 starts exposure after the elapse of a predetermined time from the generation of the I-top signal. The photosensitive drum 1 rotates an integral number of times while the belt 2 rotates once, returning the positional relationship between the photosensitive drum 1 and the belt 2 to substantially the same state as before the rotation of the belt 2. This forms toner images at the same position on the belt 2. Toner images formed on a sheet vary in size when sheet size is varied. However, the belt 2 is larger than the usable maximum sheet size and thus may have a range where a toner image is not transferred if a used sheet is smaller than the maximum size.

[Block Diagram of a Control System]

Figure 2:
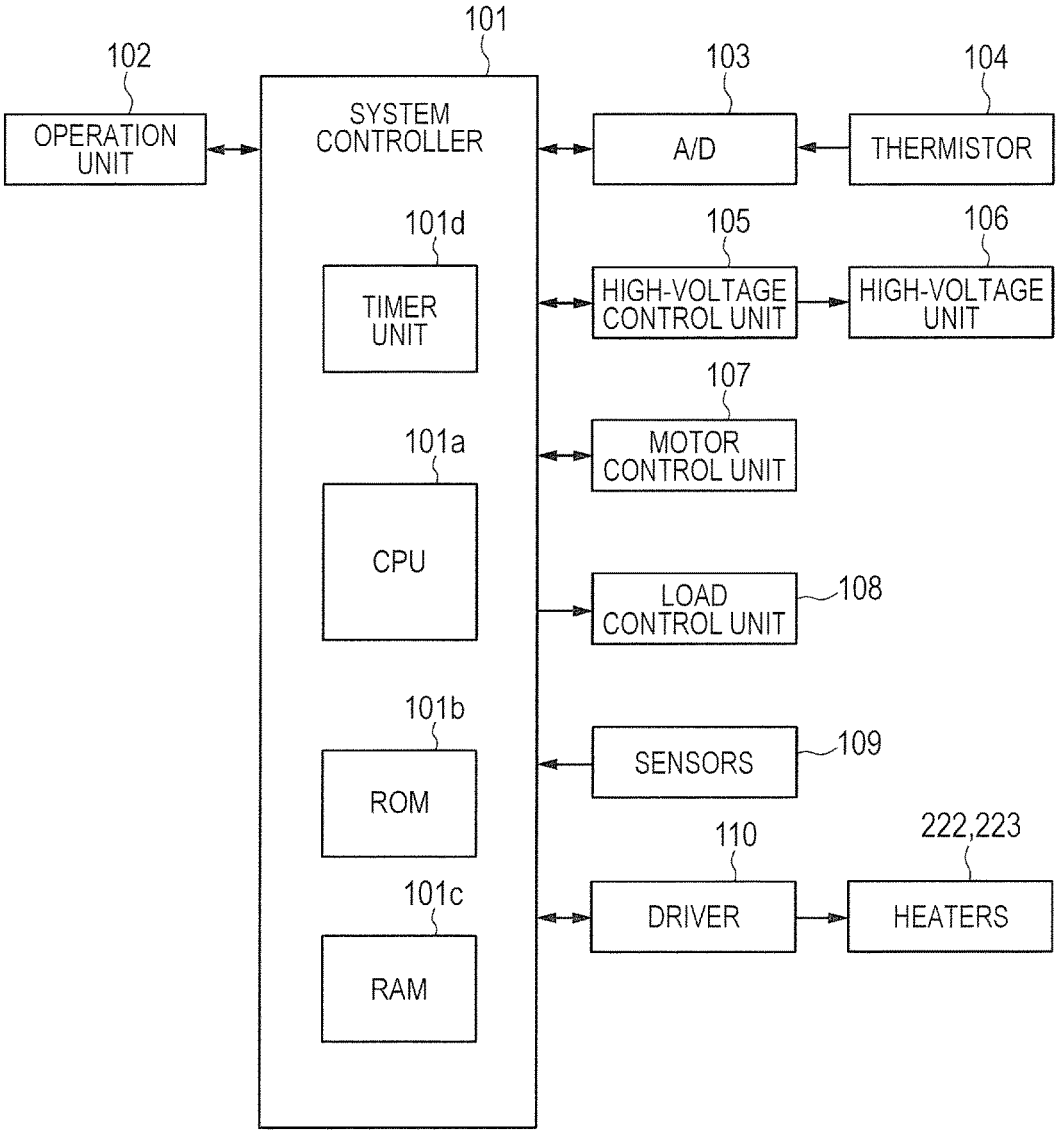
FIG. 2 is a block diagram illustrating the image forming apparatus according to first and second embodiments.

FIG. 2 is a block diagram illustrating the control system according to the present embodiment. A system controller (hereinafter, simply described as a controller) 101 overall controls the body 40. The controller 101 mainly controls driving of each load in the body 40, collection and analysis of information detected by sensors, and data transmission/reception to and from an operation unit 102, that is, a user interface. The controller 101 includes a CPU 101*a* acting as a control unit. The CPU 101*a* performs various sequences about a predetermined image formation sequence according to programs stored in a ROM 101*b* that is installed in the controller 101. The controller 101 also includes a RAM 101*c* for storing rewritable data that needs to be temporarily or permanently stored when the CPU 101*a* performs the various sequences. The RAM 101*c* stores, for example, set values for a high-voltage control unit 105, various kinds of data, and command information on image formation from the operation unit 102. The controller 101 includes a timer unit 101*d* that allows the CPU 101*a* to measure a time.

The operation unit 102 is used to obtain information set by a user, for example, a copy magnification and a density set value. The operation unit 102 has a display unit that is used to inform the user of a state of the body 40, for example, the number of sheets on which images are formed, information on whether an image is being formed or not, the occurrence of a jam, and an occurrence point of the jam.

At various locations in the apparatus, the body 40 has one motor or multiple motors, loads such as a clutch/solenoid, and sensors such as a photo interrupter or a micro switch. In the body 40, the motors and the loads are driven, thereby transporting the recording material and driving each unit. The various sensors monitor the actions of the driven members. The controller 101 controls each motor by means of a motor control unit 107 in response to signals output from the various sensors 109. Moreover, the controller 101 causes a load control unit 108 to operate the clutch/solenoid so as to control an image forming operation in response to the signals output from the various sensors 109. Furthermore, the controller 101 outputs a control signal to the high-voltage control unit 105. Thus, the controller 101 applies a proper high-voltage to the charger 4, the transferring apparatus 15, and the members in the developing apparatuses 7 and 8 through a high-voltage unit 106.

Figure 3:
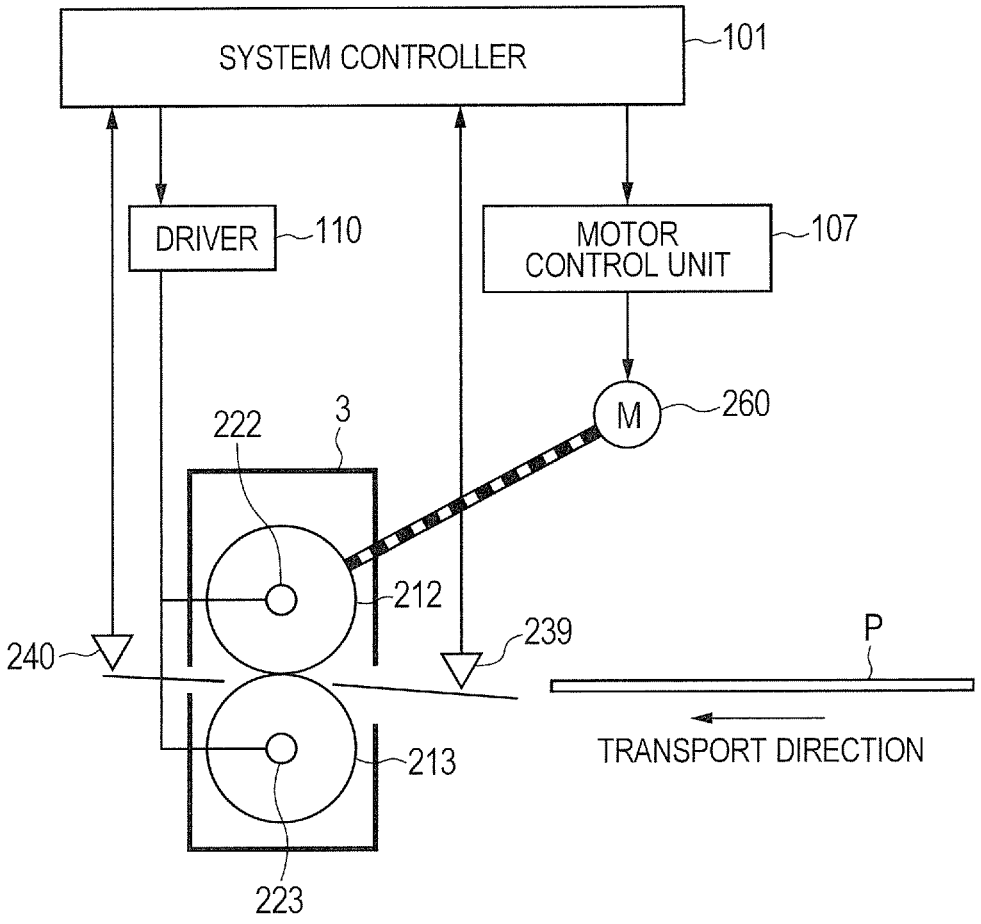
FIG. 3 is a cross-sectional view illustrating a fixing device for comparison with the first embodiment.

A fixing roller 212 serving as a heating rotary member of the fixing device 3 contains a heater 222 for heating the roller (see FIG. 3). A pressure roller 213 contains a heater 223 for heating the roller (see FIG. 3). The supply of an alternating voltage to the heaters 222 and 223 is turned on or off by a driver 110. The fixing roller 212 is provided with a thermistor 104 that acts as a temperature detector for measuring a temperature. The thermistor 104 outputs an analog voltage value as a detection result to an A/D 103, the analog voltage value indicating a change of a resistance value according to a temperature change of the fixing roller 212. The A/D 103 converts the input analog voltage value to a digital value and then outputs the value to the controller 101. The controller 101 controls the driver 110 based on temperature data input from the thermistor 104 through the A/D 103.

[Fixing Device]

Referring to FIG. 3, the configuration of the fixing device 3 according to a comparative example will be described below for comparison with the present embodiment. The fixing device 3 includes the fixing roller 212 acting as a first rotary member and the pressure roller 213 acting as a second rotary member. The fixing roller 212 and the pressure roller 213 are rotatably disposed so as to be pressed to each other by the pressing mechanism (not shown). The first and second rotary members may be belts or endless films instead of rollers. The fixing roller 212 that is a heating rotary member contains a heater 222 acting as a heating element, e.g., a halogen heater. The pressure roller 213 that is a pressure rotary member contains a heater 223 acting as a heating element, e.g., halogen heater. The fixing roller 212 is driven to rotate by a motor 260 (denoted as M in FIG. 3) acting as a driving unit. The pressure roller 213 is driven to rotate by the rotation of the fixing roller 212. The motor 260 may drive to rotate the pressure roller 213. The controller 101 controls the motor 260 via the motor control unit 107. The control of the motor 260 will be specifically described later.

The thermistor 104 acting as a temperature detector is in contact with the fixing roller 212 and the pressure roller 213 (see FIG. 2). The controller 101 determines the surface temperatures of the fixing roller 212 and the pressure roller 213 based on the results detected by the thermistor 104. The controller 101 controls power supplied to the heaters 222 and 223 with reference to the temperature detected by the thermistor 104. Thus, the controller 101 controls the heaters 222 and 223 via the driver 110 so as to keep the temperatures of the fixing roller 212 and the pressure roller 213 at a predetermined temperature. The controller 101 controls the fixing device 3 to be kept at a predetermined constant temperature suitable for fixing a toner image on the recording material P. The recording material P is transported so as to be held at the nip portion between the fixing roller 212 and the pressure roller 213.

As shown in FIG. 3, an inlet sensor 239 that is a first detecting unit is provided on a transport path upstream the fixing device 3 in the transport direction of the recording material P. An outlet sensor 240 that is a second detecting unit is provided on a transport path downstream the fixing device 3 in the transport direction of the recording material P. The inlet sensor 239 and the outlet sensor 240 are provided to detect the presence or absence of the recording material P on an upstream side and a downstream side of the fixing device 3 in the transport direction of the recording material. When the recording material P is transported to the nip portion between the fixing roller 212 and the pressure roller 213 to perform fixing process, there may occur a phenomenon in which the recording material P is wrapped around the fixing roller 212 or the pressure roller 213 (hereinafter, described as a wrapping jam). When the wrapping jam has occurred, the rotations of the fixing roller 212 and the pressure roller 213 need to be stopped at a timing as soon as possible. It is important to stop the rotations of the fixing roller 212 and the pressure roller 213, thereby preventing the trailing end of the recording material P from being inserted into the fixing device 3 in a state that the recording material P is wrapping around the fixing roller 212 or the pressure roller 213.

[Detection of the Wrapping Jam]

Figure 4A:
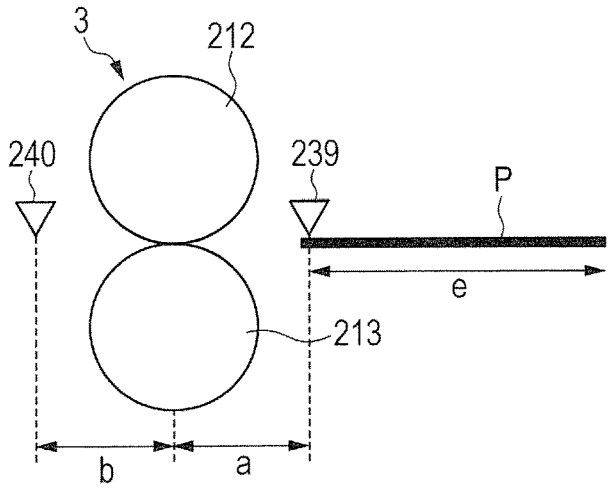
FIG. 4A, FIG. 4B and FIG. 4C illustrate the positions of the recording material when the wrapping jam according to the first embodiment occurs.
Figure 4B:
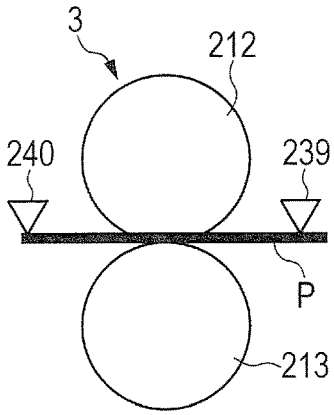
Figure 4C:
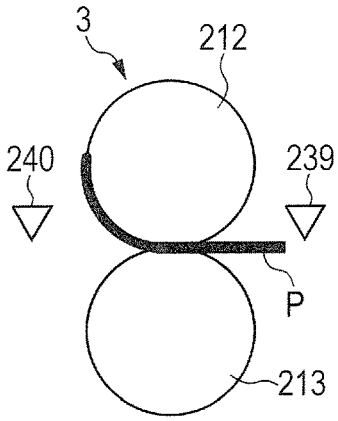
Figure 5A:
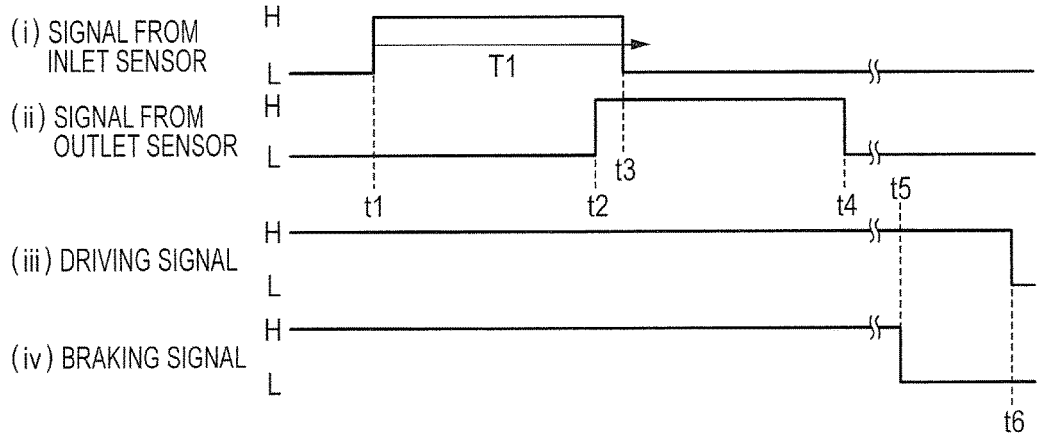
FIG. 5A, FIG. 5B and FIG. 5D are timing charts indicating waveforms of output signals according to the first embodiment.
Figure 5B:
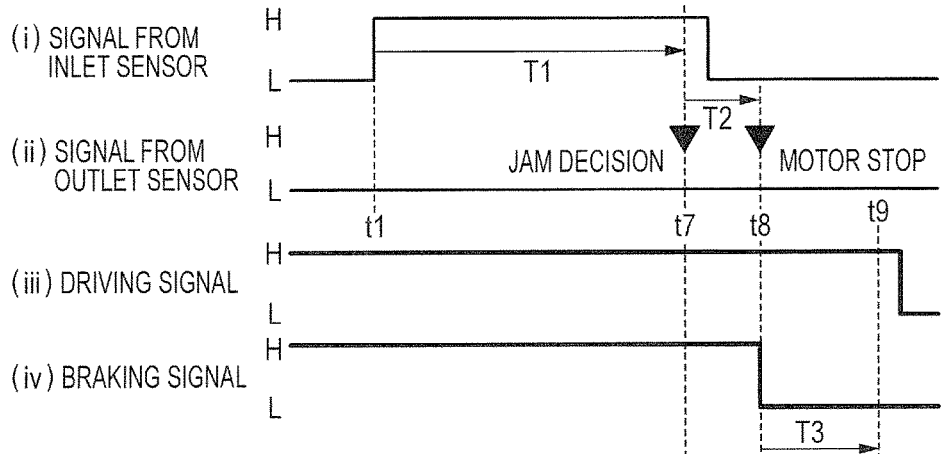

FIGS. 4A, 4B, and 4C show that the recording material P is transported to the nip portion of the fixing device 3. The principal part of the fixing device 3 is illustrated in FIGS. 4A, 4B, and 4C. FIGS. 5A and 5B are timing charts of each signal. FIG. 5A shows a case in which the wrapping jam does not occur, and FIG. 5B shows a case in which the wrapping jam occurs.

Figure 5C:
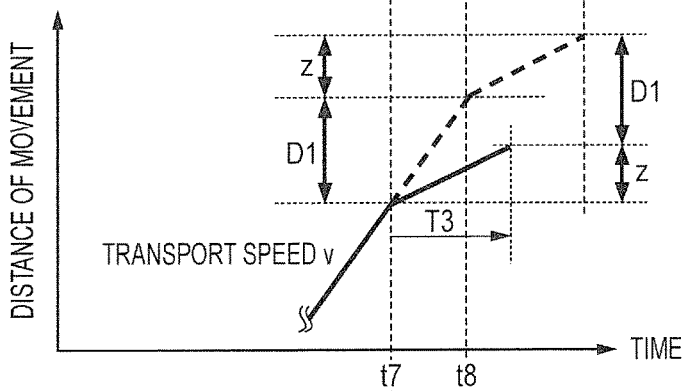
FIG. 5C is a graph of a distance of movement of the recording material.
Figure 5D:
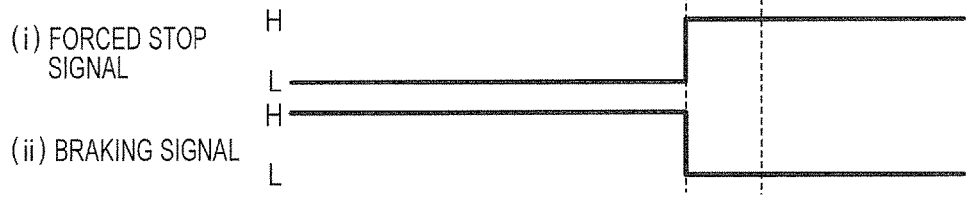

In FIGS. 5A and 5B, (i) indicates a signal output from the inlet sensor 239 when the recording material P is transported into the fixing device 3, (ii) indicates a signal output from the outlet sensor 240, (iii) indicates a driving signal that is output from the controller 101 for driving the motor 260, and (iv) indicates a braking signal that is output from the controller 101 for stopping the rotation of the motor 260. As shown in FIG. 4A, a distance a ranges from a position at which the inlet sensor 239 is arranged to the nip portion between the fixing roller 212 and the pressure roller 213, and a distance b ranges from the nip portion between the fixing roller 212 and the pressure roller 213 to a position at which the outlet sensor 240 is arranged. Furthermore, the recording material P with a minimum size permitted for use in the image forming apparatus has a length e in the transport direction of the recording material. FIG. 5C is a graph of a distance of movement of the recording material P. The horizontal axis indicates a time while the vertical axis indicates the distance of movement. FIG. 5D is a timing chart of each signal during the processing of the present embodiment. (i) indicates a forced stop signal and (ii) indicates a braking signal.

FIG. 4A shows that the leading end of the recording material P has reached the inlet sensor 239. FIG. 4B shows that the leading end of the recording material P has reached the outlet sensor 240 after the recording material P is transported to the nip portion of the fixing device 3 and then is transported by the fixing roller 212. In the state of FIG. 4B, the recording material P normally reaches the outlet sensor 240 without being wrapped around the fixing roller 212. FIG. 5A is a timing chart of when the recording material P can be transported without the wrapping jam occurring as illustrated in FIG. 4B.

At timing t1 when the leading end of the recording material P has reached the inlet sensor 239 as illustrated in FIG. 4A, the output of the inlet sensor 239 changes from a low level to a high level. While the recording material P passes through the inlet sensor 239, the output of the inlet sensor 239 is kept at the high level. The recording material P is further transported such that the trailing end of the recording material P passes through the inlet sensor 239 at timing t3, to change the output of the inlet sensor 239 from the high level to the low level.

At timing t2 when the leading end of the recording material P has reached the outlet sensor 240 as illustrated in FIG. 4B, the output of the outlet sensor 240 changes from the low level to the high level. While the recording material P passes through the outlet sensor 240, the output of the outlet sensor 240 is kept at the high level. The recording material P is further transported such that the trailing end of the recording material P passes through the outlet sensor 240 at timing t4, to change the output of the outlet sensor 240 from the high level to the low level. After that, the CPU 101*a* changes the braking signal from the high level to the low level at timing t5 and changes the driving signal from the high level to the low level at timing t6.

The motor control unit 107 outputs a high-level driving signal when rotating the motor 260, and outputs a low-level driving signal when stopping the rotation of the motor 260 (hereinafter, simply described as stopping of the motor 260). The motor 260 naturally decelerates due to a rotational resistance and the like when receiving the low-level driving signal from the motor control unit 107. The motor control unit 107 outputs the braking signal to the motor 260 to increase the braking force of the motor 260. The braking force is not applied when the high-level braking signal is input to the motor 260. The braking force is applied when the low-level braking signal is input to the motor 260, thereby decelerating the motor 260 faster than that in natural deceleration.

The driving signal and the braking signal are kept at the high level while the recording material P is transported to the fixing device 3. When the transportation of the recording material P is completed at timing t4 when the trailing end of the recording material P passes through the outlet sensor 240, that is, the detection signal of the outlet sensor 240 changes from the high level to the low level, the motor control unit 107 stops the motor 260. At this point, the motor control unit 107 changes the braking signal from the high level to the low level at timing t5, thereby braking the motor 260. At subsequent timing t6, the motor control unit 107 changes the driving signal from the high level to the low level, thereby stopping the driving of the motor 260.

The occurrence of the wrapping jam in the fixing device 3 will be described below. If the leading end of the recording material P transported into the fixing device 3 is wrapped around the fixing roller 212, the output of the outlet sensor 240 is kept at the low level even after the elapse of a predetermined time (T1 which will be discussed later) from when the inlet sensor 239 detects the leading end of the recording material P. As indicated at timing t7 in FIG. 5B, if it is decided that the wrapping jam has occurred, the controller 101 causes the motor control unit 107 to stop the motor 260 at timing t8 so as not to further insert the recording material P into the fixing device 3.

If the recording material P is wrapped around the fixing roller 212, as illustrated in FIG. 4C, the leading end of the recording material P does not reach the outlet sensor 240. In other words, the detection signal output from the outlet sensor 240 is kept at the low level. In this case, at timing t7 after the elapse of the time T1 (limit value T1) with respect to timing t1 when the inlet sensor 239 changes from the low level to the high level, the controller 101 decides that the recording material P is wrapped around the fixing roller 212. At timing t8 after the elapse of a time T2 required for internal processing from timing t7, the CPU 101*a* stops the motor 260 via the motor control unit 107. Specifically, at timing t8, the CPU 101*a* changes the braking signal from the high level to the low level via the motor control unit 107. The motor 260 stops at timing t9 after the elapse of a time T3 during which the braking signal input from the motor control unit 107 changes from the high level to the low level, the time T3 being determined by the rotation number or inertia of the motor. The time T3 is a time required from when changing the braking signal from the high level to the low level to when stopping the motor 260. Then the CPU 101*a* changes the driving signal from the high level to the low level.

The recording material P is transported for a distance z from timing t8 to timing t9, that is, while the motor 260 is braked. Moreover, the recording material P is transported with a transport speed v. The motor 260 moves the recording material P according to the delay of the time T2 necessary for the internal processing of the CPU 101*a*. The recording material P is transported by the rotation of the motor 260 for D1 =v×T2 where D1 is the distance of movement.

[Detection of the Wrapping Jam According to the Comparative Example]

Figure 6:
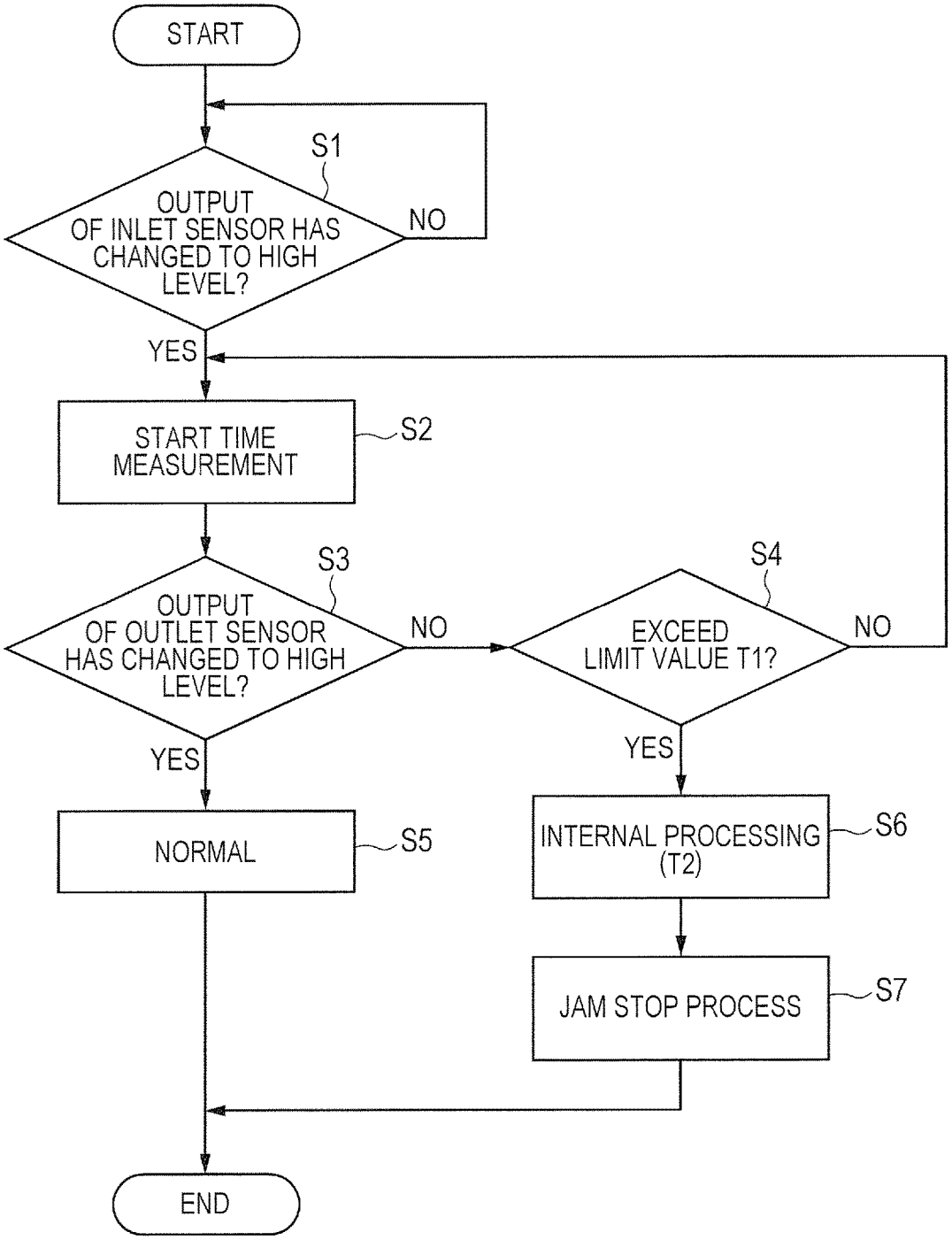
FIG. 6 is a flowchart indicating a detection process of the wrapping jam for comparison with the first embodiment.

FIG. 6 is a flowchart indicating the detection of the wrapping jam of the recording material P passing through the fixing device 3 according to the comparative example, for comparison with the present embodiment. The CPU 101*a* in the controller 101 controls the motor 260 to rotate so as to normally transport the recording material in addition to detect the wrapping jam of the recording material. The CPU 101*a* monitors the outputs of the inlet sensor 239 and the outlet sensor 240. The CPU 101*a* decides the occurrence of the wrapping jam based on the output states of the two sensors, and stops the motor 260. The CPU 101*a* resets the timer unit 101*d* at the start of the following processing.

In step (hereinafter, described as S) S1, the CPU 101*a* decides whether the output of the inlet sensor 239 has changed from the low level to the high level, that is, whether the leading end of the recording material P has reached the inlet sensor 239. If the CPU 101*a* decides that the output of the inlet sensor 239 has not changed to the high level in S1, the processing of S1 is repeated. If the CPU 101*a* decides that the output has changed to the high level, the processing advances to S2. In S2, the CPU 101*a* causes the timer unit 101*d* to start a time measurement.

In S3, the CPU 101*a* decides whether the output of the outlet sensor 240 has changed from the low level to the high level, that is, whether the leading end of the recording material P has reached the outlet sensor 240. If the CPU 101*a* decides that the output of the outlet sensor 240 has not changed to the high level in S3, the processing advances to S4. In S4, the CPU 101*a* decides whether a measurement value obtained by the timer unit 101*d* has exceeded the predetermined limit value T1. In S4, if the CPU 101*a* decides that the measurement value has not exceeded the limit value T1, the processing returns to S2. In S4, if the CPU 101*a* decides that the measurement value has exceeded the limit value T1, the processing advances to S6. In S6, the CPU 101*a* performs internal processing for stopping the motor 260. In S7, the CPU 101*a* performs stop process to stop the motor 260. The internal processing performed by the CPU 101*a* in S6 requires the time T2.

The limit value T1 will be discussed below. In order to facilitate jam processing by the CPU 101*a* when the wrapping jam of the recording material P on the fixing roller 212 occurs, the following state is necessary. That is, when the motor 260 is stopped, the inlet sensor 239 is in a state of detecting the recording material P before the trailing end of the recording material P passes through the inlet sensor 239. In order to stop the transportation of the recording material P in the state that the inlet sensor 239 detects the recording material P after the braking signal changes to the low level, the limit value T1 of a counter is determined so as to satisfy the following Expression (1) or (2).

$$(a+b)\div v<(T1+T2\max)<(e-z)\div v \qquad \text{Expression(1)}$$

$$(a+b)\div v<(T1+T2\min)<(e-z)\div v \qquad \text{Expression(2)}$$

The time T2 required for the internal processing of the CPU 101*a* depends on a used CPU or a software structure and typically fluctuates. Therefore, a delay of about 10 ms to 100 ms occurs. The fluctuation of the time T2 has a minimum value T2min and a maximum value T2max.

If the outlet sensor 240 can detect the leading end of the recording material P before the elapse of the time of the limit value T1 from the detection of the leading end of the recording material P by the inlet sensor 239, the CPU 101*a* decides that the recording material P is normally transported. Meanwhile, even after the elapse of the time of the limit value T1 from the detection of the leading end of the recording material P by the inlet sensor 239, if the outlet sensor 240 cannot detect the leading end of the recording material P, the CPU 101*a* makes the following decision. That is, the CPU 101*a* decides that the wrapping jam of the recording material P has occurred in the fixing device 3. When the wrapping jam occurs, the CPU 101*a* outputs the braking signal (low level) to the motor control unit 107 and the motor control unit 107 stops the motor 260.

Return to the explanation of FIG. 6, it is decided in S7 that the wrapping jam has occurred, and processing for stopping the transportation of the recording material P (hereinafter, described as jam stop process) is performed and the processing is completed. If the CPU 101*a* decides that the output of the outlet sensor 240 has changed to the high level in S3, the CPU 101*a* decides that the recording material P is normally transported and then the processing is completed. However, the time T1 may not be set to satisfy the Expression (1) or (2), depending on the fluctuation of the time T2 required for the internal processing of the CPU 101*a*.

[Delay Detecting Unit]

Figure 7:
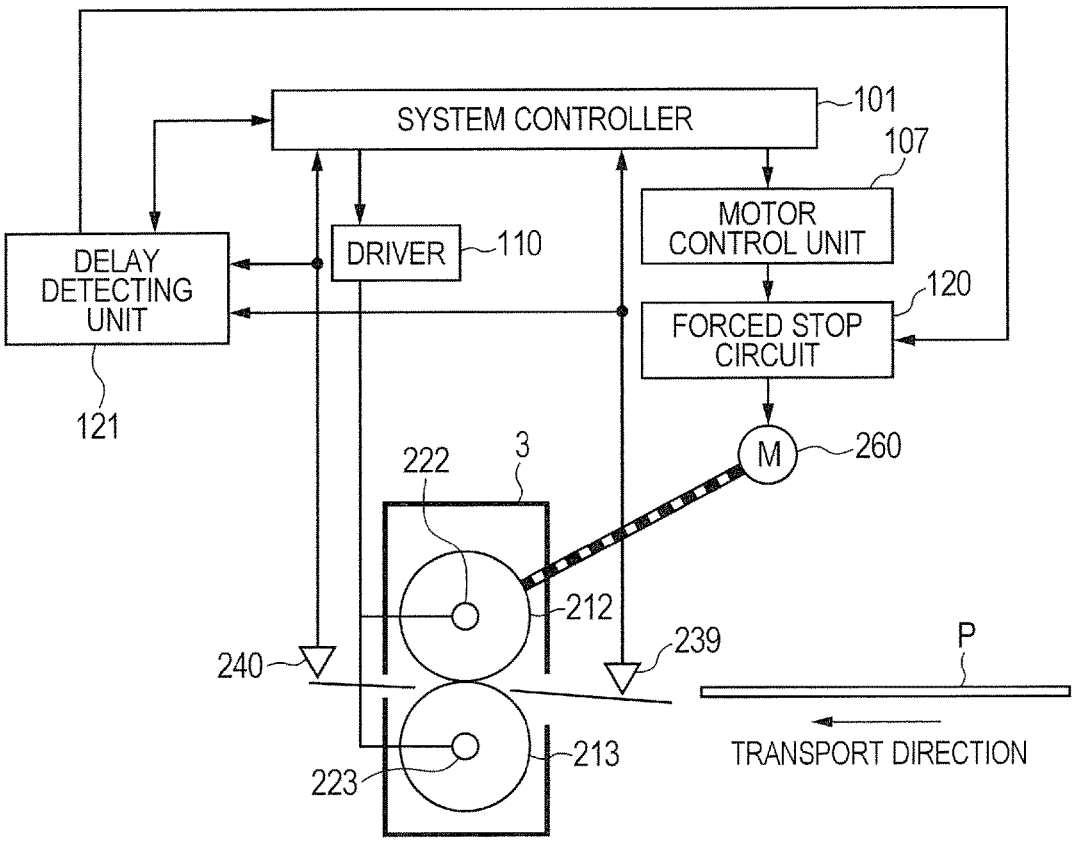
FIG. 7 is a block diagram illustrating a fixing device according to the first embodiment.

FIG. 7 is a block diagram illustrating the control system of the fixing device 3 according to the present embodiment. The same configurations as the configurations described in FIG. 3 are indicated by the same reference numerals and the description thereof is omitted. The image forming apparatus according to the present embodiment includes a delay detecting unit 121 and a forced stop circuit 120. The delay detecting unit 121 outputs a signal for forcibly stopping the motor 260, but does not control the motor 260 to rotate for normally transporting the recording material. The system controller 101 and the motor control unit 107 control the motor 260 to rotate for normally transporting the recording material. Moreover, the system controller 101 and the motor control unit 107 also control the motor 260 to stop its rotation after the recording material is normally transported and passes through the fixing device 3. The stop control performed by the system controller 101 and the motor control unit 107 involves control using the forced stop circuit 120 and stop control that naturally stops the motor 260 by stopping the output of the driving signal.

The delay detecting unit 121 and the forced stop circuit 120 act as stopping units independent of the system controller 101 and the motor control unit 107. The delay detecting unit 121 monitors the detection signals of the inlet sensor 239 and the outlet sensor 240. The delay detecting unit 121 decides whether the wrapping jam has occurred, based on the detection signals of the inlet sensor 239 and the outlet sensor 240. Moreover, the delay detecting unit 121 outputs the forced stop signal used for forcibly stopping the motor 260, to the forced stop circuit 120. The delay detecting unit 121 also acts as a decision unit. If it is decided that the wrapping jam has occurred, the delay detecting unit 121 informs to the CPU 101*a* that the wrapping jam has occurred and the motor 260 has been forcibly stopped. The CPU 101*a* reads, for example, the limit value T1 predetermined by an experiment from the ROM 101*b* and sets the read limit value T1 for the delay detecting unit 121.

The delay detecting unit 121 includes, for example, a Field-Programmable Gate Array (FPGA), a dedicated CPU, or a hardware circuit not operated by a software operation. The limit value T1 is set in advance for the delay detecting unit 121 by the CPU 101*a*. The delay detecting unit 121 performs detection process. If it is decided that the wrapping jam has occurred, the delay detecting unit 121 outputs the forced stop signal to the forced stop circuit 120 with a minimum time (e.g., 1 ms or less). The delay detecting unit 121 may include a circuit having a higher operating speed than the CPU 101*a* of the controller 101.

[The Detection Process of the Wrapping Jam According to the Present Embodiment]

Figure 8:
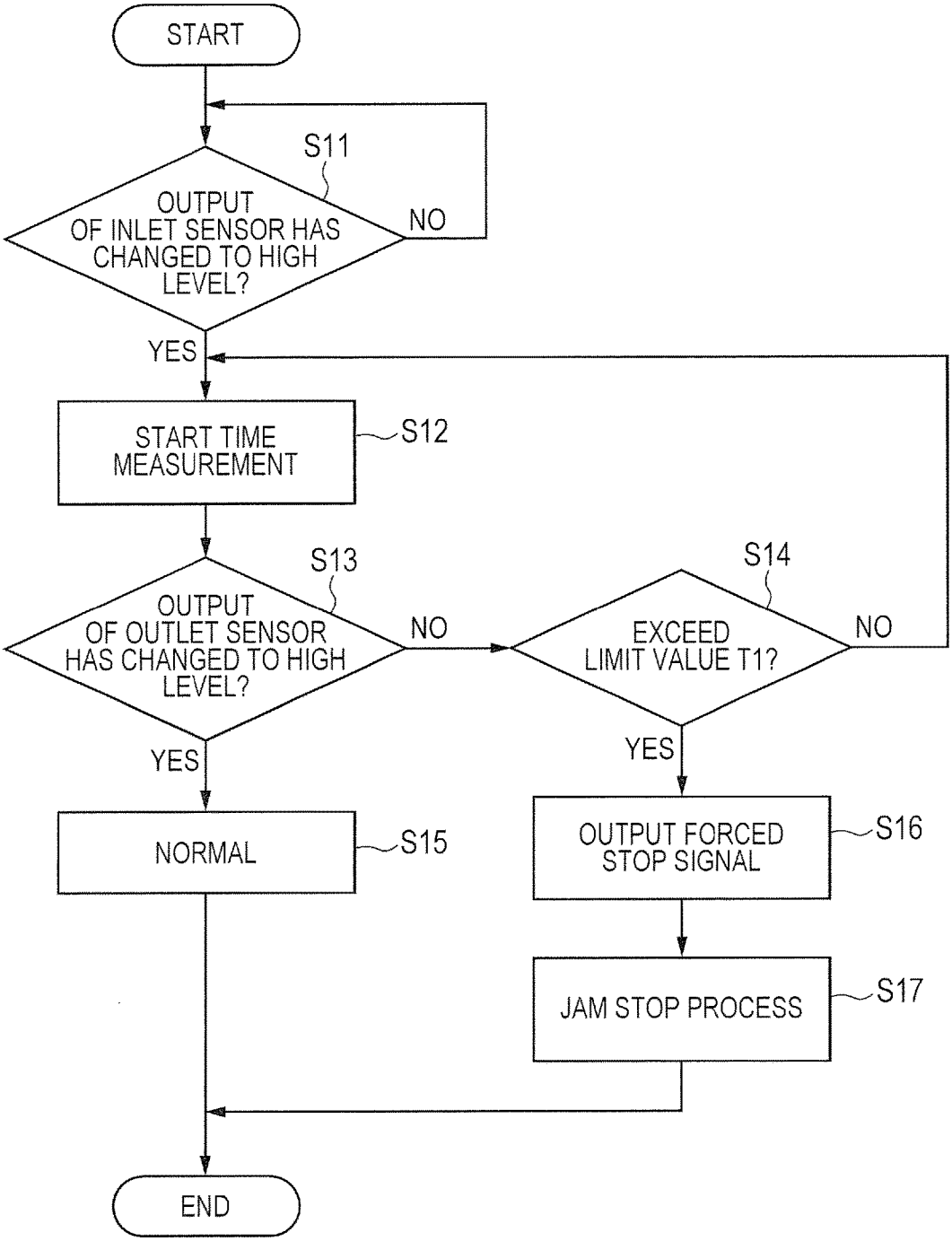
FIG. 8 is a flowchart indicating a detection process of the wrapping jam according to the first embodiment.

FIG. 8 is a flowchart indicating the detection process of the wrapping jam by the delay detecting unit 121 when the forced stop circuit 120 performs the stop process for the motor 260 according to the present embodiment. The processing in FIG. 8 is performed by the delay detecting unit 121. The processing in S11 to S15 and S17 is identical to that of S1 to S5 and S7 described in FIG. 6 and the description thereof is omitted. In S16, the delay detecting unit 121 causes the forced stop circuit 120 to output the forced stop signal to the motor 260.

[Forced Stop Unit]

Figure 9:
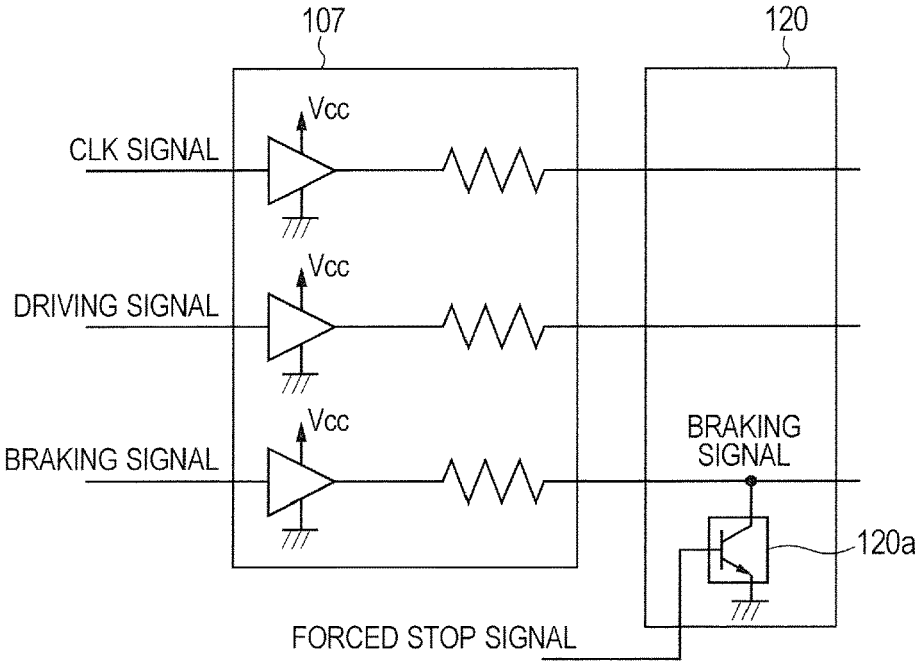
FIG. 9 is a block diagram illustrating a forced stop unit according to the first embodiment.

FIG. 9 illustrates an example of the motor control unit 107 and the forced stop circuit 120. The CPU 101*a* outputs a CLK signal for controlling the speed of the motor 260, the driving signal for driving the motor 260, and the braking signal for stopping the rotation of the motor 260, to the motor 260 through the motor control unit 107. The forced stop circuit 120 includes a transistor 120*a*. The collector terminal of the transistor 120*a* is connected to the signal line of the braking signal output from the motor control unit 107. To a base terminal of the transistor 120*a*, the forced stop signal is input from the delay detecting unit 121, and an emitter terminal is grounded.

When the forced stop signal is input at a high level from the delay detecting unit 121, the transistor 120*a* is turned on, and the braking signal output from the motor control unit 107 is forcibly set at the low level. In other words, the delay detecting unit 121 outputs the braking signal independently of the system controller 101 and the motor control unit 107. Thus, in the present embodiment, the delay detecting unit 121 at timing t7 in FIG. 5D changes the forced stop signal output to the forced stop circuit 120 from the low level to the high level. Moreover, the forced stop circuit 120 outputs the braking signal at the low-level to the motor 260 at timing t7, thereby instructing the motor 260 to stop. The recording material P travels over the distance z until when the motor 260 is stopped from when the forced stop circuit 120 instructs the motor 260 to stop the motor 260.

Thus, in the present embodiment, the transportation of the recording material P can be stopped sooner than that of the related art by the time T2 required for the internal processing of the CPU 101*a*, thereby reducing the amount of wrapping around the fixing roller 212 by the distance D1 than that of the related art. In FIG. 5C, the comparative example described in FIG. 6 is plotted by a broken line and the present embodiment described in FIG. 8 is plotted by a solid line. When the delay detecting unit 121 does not decide the occurrence of the wrapping jam, the forced stop signal at the low level is input to the forced stop circuit 120. In this case, the transistor 120*a* is turned off, and the forced stop circuit 120 outputs the braking signal input from the motor control unit 107 to the motor 260 as it is.

In the present embodiment, the delay detecting unit 121 decides the wrapping jam of the recording material P based on the detection signals of the inlet sensor 239 and the outlet sensor 240 and outputs the forced stop signal to the forced stop circuit 120. The forced stop circuit 120 sets the braking signal at the low level in response to the forced stop signal input from the delay detecting unit 121 at the high-level, thereby forcibly stopping the motor 260. In the present embodiment, the motor 260 is forcibly stopped without delay, and thus the amount of wrapping of the recording material P around the fixing roller 212 can be reduced even when the wrapping jam occurs. In the present embodiment, the motor 260 is forcibly stopped. The heaters 222 and 223 may be stopped by a stopping unit (not shown) along with the forcibly stopping of motor 260.

As described above, the present embodiment can reduce the wrapping amount of the recording material around the rotary member, if the recording material is wrapped around the rotary member.

Second Embodiment

[Detection of the Wrapping Jam]

Figure 10:
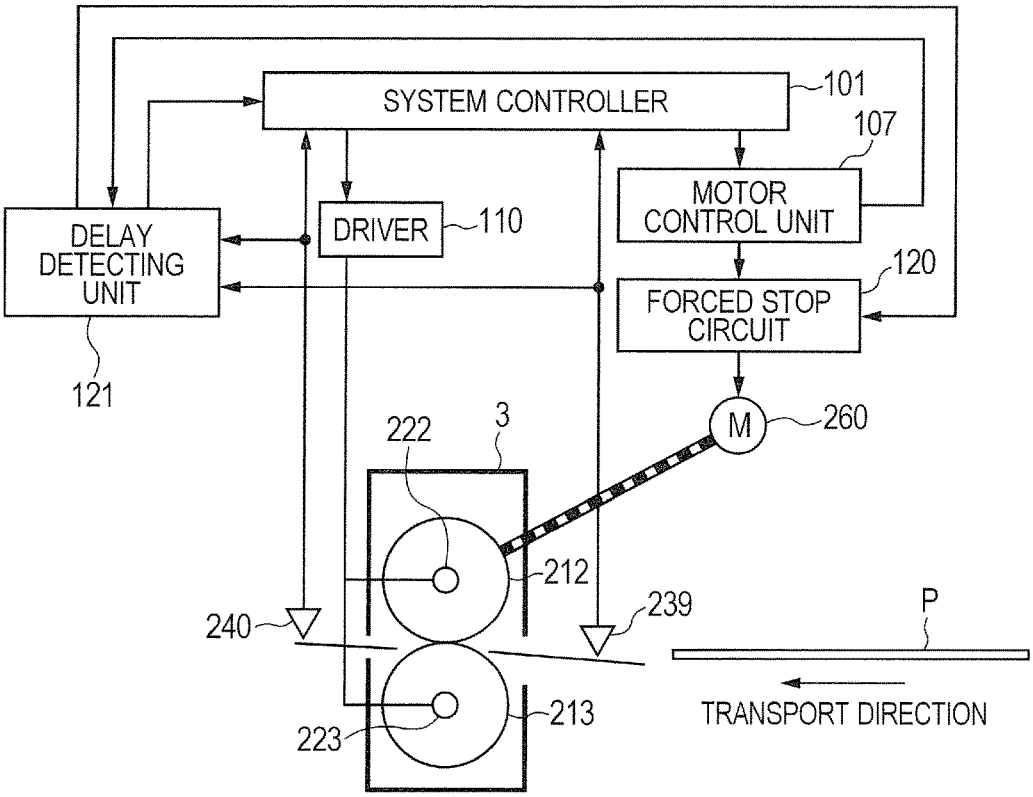
FIG. 10 is a block diagram illustrating a fixing device according to the second embodiment.

A second embodiment will describe a method of determining a time T1 that is a predetermined time. The schematic configuration and operations of the image forming apparatus, the detection of the wrapping jam, and the forced stop of the motor 260 are identical to those of the first embodiment and thus the description thereof is omitted. FIG. 10 illustrates the configuration of a fixing device according to the present embodiment. The same configurations as the configurations described in FIG. 7 are indicated by the same reference numerals and the description thereof is omitted. A motor control unit 107 according to the present embodiment outputs a signal corresponding to the rotation of the motor 260, e.g., a CLK signal or an FG signal to the delay detecting unit 121. The CLK signal or the FG signal is used for controlling the rotation number of the motor 260. The delay detecting unit 121 determines the time T1 based on the CLK signal or the FG signal input from the motor control unit 107. The time T1 is determined so as to satisfy the following Expression (3).

$$(a+b)\div v<T1<(e-z)\div v \qquad \text{Expression(3)}$$

The delay detecting unit 121 determines a distance z over which a recording material P is transported at time T3 (see FIG. 5C) and a transport speed v of the recording material P based on the CLK signal or the FG signal input from the motor control unit 107. Thus, the delay detecting unit 121 can determine the time T1 satisfying the Expression (3). The delay detecting unit 121 performs the control described in the first embodiment, by using the time T1 determined so as to satisfy the Expression (3).

As described above, the present embodiment can reduce the wrapping amount of the recording material around the rotary member, if the recording material is wrapped around the rotary member.

In the foregoing embodiment, a time is measured using the timer unit 101*d* to decide whether the time has exceeded the limit value T1. The timer unit 101*d* may be replaced with a counter (not shown). Moreover, the CLK signal or the FG signal output from the motor control unit 107 to the delay detecting unit 121 may be replaced with a signal output from, for example, an encoder provided on a shaft of the motor 260. Furthermore, in the foregoing embodiment, the wrapping of the recording material P around the fixing roller 212 in the fixing device 3 is detected. The same configuration may be applied to detect wrapping of the recording material P around other rollers.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-154290, filed Aug. 4, 2015, which is hereby incorporated by reference herein in its entirety.

REFERENCE SIGNS LIST

101*a* CPU
120 forced stop circuit
121 delay detecting unit
212 fixing roller
239 inlet sensor
240 outlet sensor
260 motor

The invention claimed is:

1. An image forming apparatus comprising:
a rotary member that transports a recording material;
a first detecting unit which is provided upstream of the rotary member with respect to a transport direction of the recording material and detects the recording material;
a second detecting unit which is provided downstream of the rotary member with respect to the transport direction of the recording material and detects the recording material;
a driving unit which drives the rotary member;
a control unit which controls the driving unit to rotate and stop the rotary member; and
a stopping unit which operates independently of the control unit and forcibly stops the driving unit based on detection results of the first detecting unit and the second detecting unit,
wherein the stopping unit has a higher operating speed than the control unit.

2. The image forming apparatus according to claim 1, wherein, in a case that the second detecting unit does not detect a leading end of the recording material after elapse of a predetermined time from detection of the leading end of the recording material by the first detecting unit, the stopping unit forcibly stops the driving unit.

3. The image forming apparatus according to claim 1, wherein, in a case that the second detecting unit does not detect a leading end of the recording material after elapse of a predetermined time from detection of the leading end of the recording material by the first detecting unit, the control unit decides that the recording material is wrapped around the rotary member.

4. The image forming apparatus according to claim 1, wherein the control unit naturally stops the driving unit based on the detection results of the first detecting unit and the second detecting unit.

5. The image forming apparatus according to claim 1, further comprising a fixing unit which fixes a toner image formed on the recording material, the fixing unit having the rotary member.

6. The image forming apparatus according to claim 5, wherein the rotary member is a fixing roller.

7. An image forming apparatus comprising:
a rotary member that transports a recording material;
a first detecting unit which is provided upstream of the rotary member with respect to a transport direction of the recording material and detects the recording material;
a second detecting unit which is provided downstream of the rotary member with respect to the transport direction of the recording material and detects the recording material;
a driving unit which drives the rotary member;
a control unit which controls the driving unit to rotate and stop the rotary member; and
a stopping unit which operates independently of the control unit and forcibly stops the driving unit based on detection results of the first detecting unit and the second detecting unit,
wherein the stopping unit includes:
a delay detecting unit which monitors detection signals of the first detecting unit and the second detecting unit and outputs a forced stop signal based on the detection signals; and
a forced stop circuit which forcibly stops the driving unit by outputting a braking signal independently of the control unit in response to the forced stop signal input from the delay detecting unit.

8. An image forming apparatus comprising:
a rotary member that transports a recording material;
a first detecting unit which is provided upstream of the rotary member with respect to a transport direction of the recording material and detects the recording material;
a second detecting unit which is provided downstream of the rotary member with respect to the transport direction of the recording material and detects the recording material;
a driving unit which drives the rotary member;
a control unit which controls the driving unit to rotate and stop the rotary member; and
a stopping unit which operates independently of the control unit and forcibly stops the driving unit based on detection results of the first detecting unit and the second detecting unit,
wherein, in a case that the second detecting unit detects a leading end of the recording material before elapse of a predetermined time from detection of the leading end of the recording material by the first detecting unit, the stopping unit does not forcibly stop the driving unit.

9. An image forming apparatus comprising:
a rotary member that transports a recording material;
a first detecting unit which is provided upstream of the rotary member with respect to a transport direction of the recording material and detects the recording material;
a second detecting unit which is provided downstream of the rotary member with respect to the transport direction of the recording material and detects the recording material;
a driving unit which drives the rotary member;
a control unit which controls the driving unit to rotate and stop the rotary member; and
a stopping unit which operates independently of the control unit and forcibly stops the driving unit based on detection results of the first detecting unit and the second detecting unit,
wherein, in a case that the second detecting unit does not detect a leading end of the recording material after elapse of a predetermined time from detection of the leading end of the recording material by the first detecting unit, the stopping unit forcibly stops the driving unit, and
wherein the predetermined time is determined so as to satisfy the following expression:

$$(a+b)\div v<T<(e-z)\div v$$

where T is the predetermined time,
a is a distance between the first detecting unit and the rotary member, b is a distance between the rotary member and the second detecting unit, v is a transport speed of the recording material, e is a length of the recording material in the transport direction, and z is a distance that the recording material is transported from when the stopping unit instructs the driving unit to stop until when the driving unit stops.

10. The image forming apparatus according to claim 9, wherein a signal corresponding to a rotation of the driving unit is input to the stopping unit, and the stopping unit obtains the transport speed v and the distance z based on the signal and determines the predetermined time T.

* * * * *